US006040512A

United States Patent [19]

Polley

[11] Patent Number: 6,040,512

[45] Date of Patent: Mar. 21, 2000

[54] GUITAR PICK WITH HOOK AND LOOP CLOSURE MATERIAL

[76] Inventor: Zackery Polley, 5671 Miles Ave., #D, Oakland, Calif. 94618

[21] Appl. No.: 09/099,478

[22] Filed: Jun. 18, 1998

[51] Int. Cl.[7] ..... G10D 3/16

[52] U.S. Cl. ..... 84/322; 84/320

[58] Field of Search ..... 84/320–322

[56] References Cited

U.S. PATENT DOCUMENTS

| | | | |
|---|---|---|---|
| 4,785,708 | 11/1988 | Vaughan | 84/329 |
| 4,993,302 | 2/1991 | Jonathan | 84/322 |
| 5,341,715 | 8/1994 | Hucek | 84/322 |
| 5,488,892 | 2/1996 | Jespen | 84/322 |
| 5,610,349 | 3/1997 | Fogarty | 84/322 |

*Primary Examiner*—Robert E. Nappi
*Assistant Examiner*—Marlon Fletcher
*Attorney, Agent, or Firm*—Goldstein & Canino

[57] ABSTRACT

A guitar pick, substantially thin and tear drop shaped, having a gripping portion, a picking portion, and two sides. Hook closure material is attached onto one of the sides of the pick to provide superior gripping characteristics when a musician grasps the pick between their thumb and forefinger. The pick is generally used with a guitar, having strings and a guitar body. The guitar body is provided with loop closure material, so that the guitar pick may be temporarily adhered to the guitar body by bringing the hook closure material on the pick into contact with the loop closure material on the guitar body. To use the pick, the pick is simply peeled off the guitar body to free the hook closure material from the loop closure material.

6 Claims, 2 Drawing Sheets

GUITAR PICK WITH HOOK AND LOOP CLOSURE MATERIAL

BACKGROUND OF THE INVENTION

The invention relates to a guitar pick with hook and loop closure material. More particularly, the invention relates to a guitar pick which has hook closure material mounted thereon, for use with a guitar having a section of loop closure material for mating with the hook closure material on the pick, for providing a convenient storage location for said pick.

In playing a musical instrument such as a guitar, a banjo, or the like, musicians frequently utilize a pick to pluck, strum, or otherwise initiate vibration in the strings of said instrument. The standard pick is a small object which is typically held by the musician between his thumb and forefinger. At one time or another, nearly all musicians encounter difficulties with maintaining a firm grip on the pick. For example, a musician's hand may become tired by the repeated striking of the strings during play, causing the musician to loosen his grip on the pick. Further, once the musician begins to sweat, perspiration often reaches the fingertips. Because most standard picks are smooth, flat and ultra-thin, the musician's sweat can cause the surface of the pick to become wet and slippery, in turn causing the fingers to slide about on the pick. In either case, the musician either encounters difficulties in controlling the position of the pick between the thumb and forefinger, or drops the pick. The result frequently is an abrupt interruption of playing while the musician locates another pick and arranges it in the hand for use.

For the previously stated reasons, and because they are so small, guitar picks are probably one of the most often misplaced items among musical instrument accessories. Typically, guitar players keep dozens of picks around, because otherwise the pick last used might not be easy to located when play is commenced.

U.S. Pat. No. 5,610,349 to Fogarty et al. discloses a pick which seeks to improve the gripping characteristics of the pick by adding a plurality of cone shaped projections for reducing finger slipping on the pick. Unfortunately, production of the pick in Fogarty would require considerable retooling, and cannot work with the billions of picks currently in existence.

U.S. Pat. No. 4,993,302 to Jonathan, discloses a nonslip guitar pick which employs a pair of rubber mats mounted to each side of the pick, and non-hardening adhesive for making the rubber mats tacky so as to resist slipping. Unfortunately, the exposed adhesive can easily rub off onto the musician's fingers, and can also rub off onto the strings, damaging the instrument.

U.S. Pat. No. 4,711,150 to Hyduck discloses a pick which has a finger gripping portion which has a rectangular recess for accommodating the musician's fingers.

U.S. Pat. No. 5,488,892 to Jepsen, and U.S. Pat. No. 4,785,708 to Vaughan both disclose different devices which attach onto a guitar body, and provide one or more pockets for storing a pick.

While these units may be suitable for the particular purpose employed, or for general use, they would not be as suitable for the purposes of the present invention as disclosed hereafter.

SUMMARY OF THE INVENTION

It is an object of the invention to produce a guitar pick having hook closure material which provides the dual purposes of both enhancing the gripping qualities of the pick, and allowing the pick to be attached onto the side of the guitar where loop closure material is located for convenient temporary storage of the pick.

It is another object of the invention that the guitar pick according to the present invention is inexpensive to manufacture and may be used with the multitude of already existing guitar picks.

It is a further object of the invention that the guitar pick provides superior gripping qualities while maintaining a natural feel for the musician which does not interfere with normal playing of the guitar.

The invention is a guitar pick, substantially thin and tear drop shaped, having a gripping portion, a picking portion, and two sides. Hook closure material is attached onto one of the sides of the pick to provide superior gripping characteristics when a musician grasps the pick between their thumb and forefinger. The pick is generally used with a guitar, having strings and a guitar body. The guitar body is provided with loop closure material, so that the guitar pick may be temporarily adhered to the guitar body by bringing the hook closure material on the pick into contact with the loop closure material on the guitar body. To use the pick, the pick is simply peeled off the guitar body to free the hook closure material from the loop closure material.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
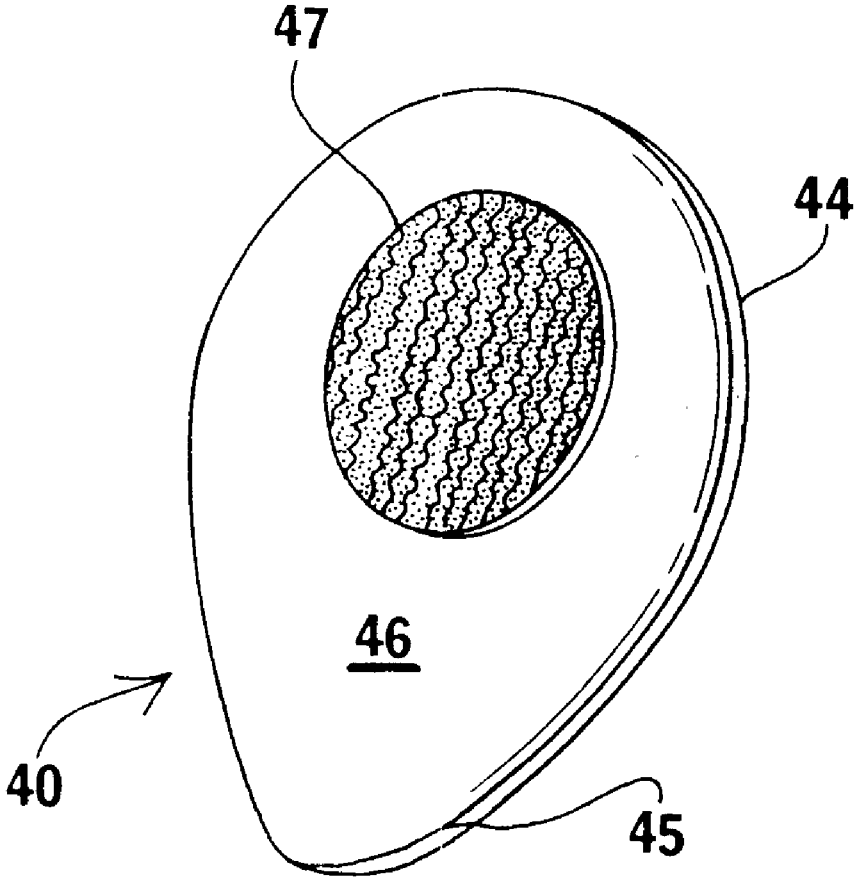
FIG. 1 is a diagrammatic perspective view of the pick, having a piece of hook closure material fastened to one of the sides thereof.

FIG. 1 illustrates a guitar pick 40. The pick is generally tear drop shaped, having a handle portion 44 which is normally grasped between the thumb and forefinger of a musician, and a picking portion 45 which contacts the strings during ordinary use of said pick 40. The pick 40 is substantially flat, having two sides 46, one of which is seen in FIG. 1, and the other of which is behind the side 46 seen in FIG. 1.

According to the present invention, hook closure material 47 is attached onto at least one side 46 of the of the pick 40. The hook closure material 47 is one component of a hook and loop fastener, which is commonly sold under the tradename VELCRO. The presence of the hook closure material 47 on the pick 40 accomplishes a primary goal of the invention, by providing a superior grip for the musician which is effectively non-slip, even after the musician's fingers become drenched with sweat.

Although the hook closure material 47 may be attached onto both sides 46 of the pick at the handle portion 44, the hook closure material 47 is preferably present on one side 46 of the pick 40, as illustrated.

Empirical testing reveals that musicians tend to develop a preference of whether to hold the pick such that the hook closure material 47 faces the thumb, or faces the forefinger. Whichever is chosen, the other finger still rests against the opposite side of the pick. However, providing the hook closure material 47 on both sides is not preferred, because provides a thick, unfamiliar feel which is undesirable to many musicians.

The hook closure material 47 may be simply adhered to one of the sides 46 of the pick 40. Adhesive backed hook closure material 47 is commonly available, and is well suited for the purposes of the invention.

Figure 2:
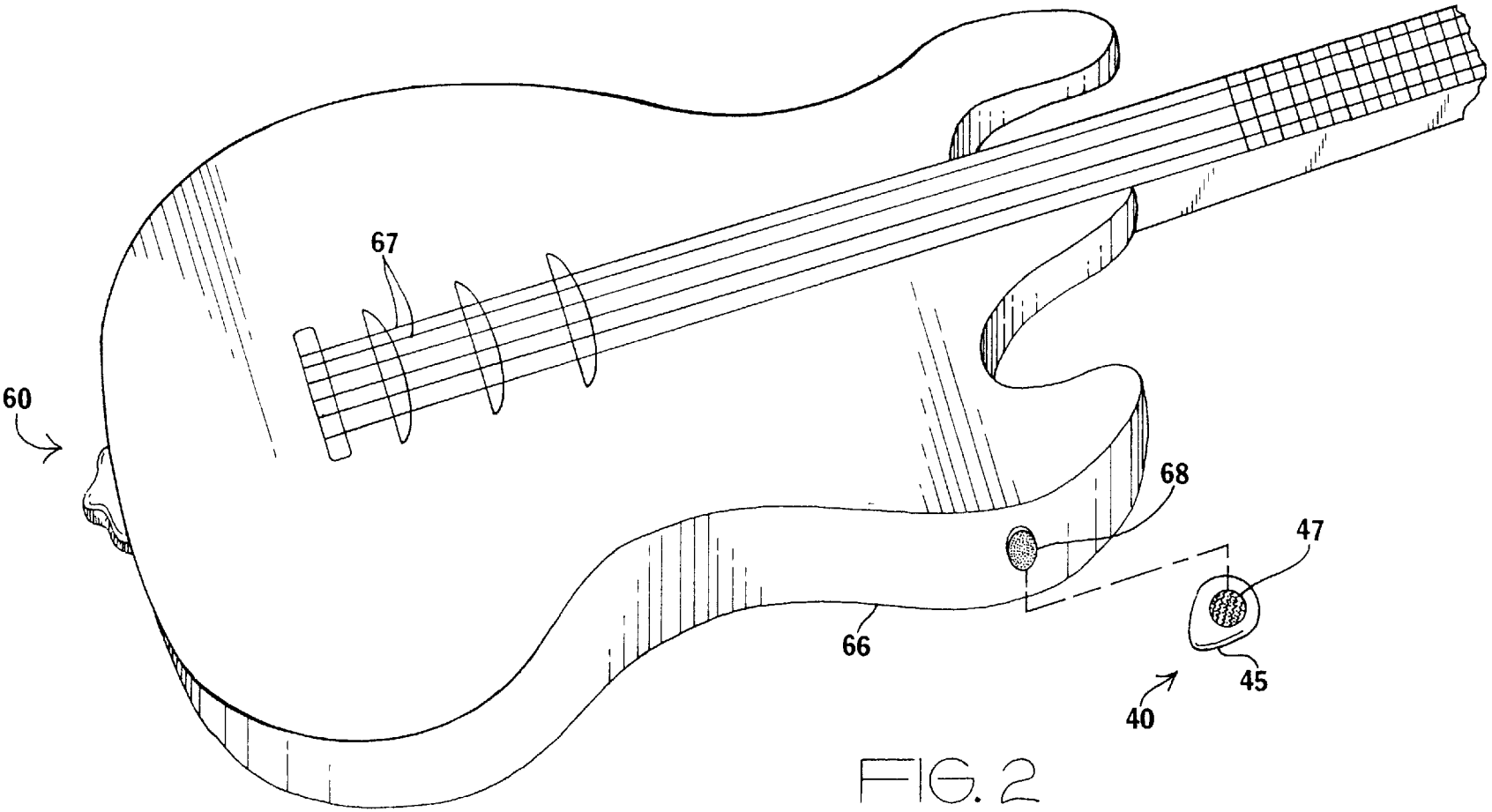
FIG. 2 is an assembly view, illustrating the pick about to be fastened to a portion of the guitar, whereas loop closure material is present on the guitar body, and wherein the hook closure material on the pick is about to be adhered to said loop closure material.

FIG. 2 is an assembly view, which illustrates a guitar 60 for use according to the present invention. The guitar 60 has a body 66 and strings 67, which the picking portion 45 normally engages when the guitar 60 is played. Loop closure material 68 is attached onto the body 66. The loop closure material 68 is also a component of the hook and loop fastener.

To accomplish the second goal of the invention, providing convenient storage for the guitar pick 40, said guitar pick may be temporarily fastened to the guitar body 66. This temporary fastening is accomplished by adhering the hook closure material 47 on the pick 40 with the loop closure material 68 on the guitar body 66. Thus, the pick 40 may be adhered to the guitar body 66 when it is not being used, to avoid loosing the pick 40. When the guitar 60 is to be played, the pick 40 is easily located by the player who can then easily peel the pick 40 off the body 66 by simply overcoming the bond between the hook closure material 47 and the loop closure material 68.

In conclusion, herein is provided a guitar pick which has hook closure material attached thereon which enhances the musician's grip upon the pick. The guitar body may also be provided with loop closure material so that the pick may be temporarily adhered to the guitar body to provide a convenient storage location for the pick while the guitar is not being played.

What is claimed is:

1. A guitar pick, for use in playing a stringed instrument such as a guitar having a guitar body, comprising:

a gripping portion;

a picking portion, the gripping portion and pick portion having an overall teardrop shape, substantially thin and having two sides; and hook closure material mounted on the gripping portion on one of the sides.

2. The guitar pick as recited in claim 1, wherein the guitar body has loop closure material mounted thereon for temporarily adhering to the hook closure material on the pick for providing a convenient storage location for the pick on the guitar body.

3. The guitar pick as recited in claim 2, wherein the hook closure material is only present on one of the sides of the pick.

4. A guitar pick method, using a pick that is substantially thin having two sides, having a gripping portion, a picking portion, and having hook closure material which is attached onto one of the sides of the gripping portion, used by a musician having a thumb and forefinger, used on a guitar having strings and a body, comprising the steps of:

holding the pick between the thumb and forefinger such that one of the thumb and forefinger rests against the hook closure material; and engaging the strings of the guitar with the picking portion of the pick.

5. The guitar pick method as recited in claim 4, wherein the guitar body has loop closure material mounted thereon, and wherein the method further comprises the steps of:

adhering the guitar pick to the guitar body by bringing the hook closure material on the pick into contact with the loop closure material on the guitar body.

6. The guitar pick method as recited in claim 5, further comprising the step of:

removing the guitar pick from the guitar body in order to once again use the pick by peeling the hook fastener material from the loop fastener material.

* * * * *